US008197174B1

(12) United States Patent
Caron et al.

(10) Patent No.: US 8,197,174 B1
(45) Date of Patent: Jun. 12, 2012

(54) AUTOMATIC BAG SLITTER, AND METHOD OF USE THEREOF

(75) Inventors: Francois Caron, Brossard (CA); Navam Jagan, Brossard (CA); Patrice Lasnier, St-Bruno-de-Montarville (CA)

(73) Assignee: Luxme Holding Inc., Brossard, Quebec (CA)

( * ) Notice: Subject to any disclaimer, the term of this patent is extended or adjusted under 35 U.S.C. 154(b) by 0 days.

(21) Appl. No.: 13/150,289

(22) Filed: Jun. 1, 2011

(51) Int. Cl.
*B65G 65/34* (2006.01)

(52) U.S. Cl. ..... 414/412; 414/810

(58) Field of Classification Search ..... 414/411, 414/412, 810; 53/381.1, 381.2, 384.1
See application file for complete search history.

(56) References Cited

U.S. PATENT DOCUMENTS

| | | | | |
|---|---|---|---|---|
| 2,660,324 | A | 11/1953 | Trautschold | |
| 3,071,911 | A * | 1/1963 | Heide | 53/381.4 |
| 3,811,586 | A | 5/1974 | Lavoie | |
| 4,034,877 | A * | 7/1977 | Bennison | 414/412 |
| 4,504,183 | A | 3/1985 | Bennison et al. | |
| 4,798,508 | A | 1/1989 | Lewis | |
| 5,188,500 | A * | 2/1993 | Eide et al. | 414/412 |
| 5,401,207 | A | 3/1995 | Hicks et al. | |
| 5,484,247 | A * | 1/1996 | Clark et al. | 414/412 |
| 5,813,192 | A | 9/1998 | White | |
| 6,079,929 | A | 6/2000 | Muma et al. | |
| 6,089,814 | A * | 7/2000 | Bayer | 414/412 |
| 6,241,097 | B1 * | 6/2001 | Roman | 209/3 |
| 6,293,318 | B1 | 9/2001 | Schmidt et al. | |
| 7,497,322 | B2 | 3/2009 | Lanfranchi | |

FOREIGN PATENT DOCUMENTS

| | | |
|---|---|---|
| EP | 114157 | 12/1987 |
| EP | 198685 | 4/1989 |
| EP | 395941 | 7/1993 |
| EP | 841273 | 5/1998 |
| EP | 1462375 | 9/2004 |
| FR | 1547391 | 10/1968 |
| GB | 2099390 | 12/1982 |
| JP | 8258820 | 10/1996 |
| JP | 10218141 | 8/1998 |
| JP | 11319617 | 11/1999 |
| WO | 2006043261 | 4/2006 |

* cited by examiner

*Primary Examiner* — Joshua Rudawitz
(74) *Attorney, Agent, or Firm* — Fraser Clemens Martin & Miller LLC; J. Douglas Miller

(57) ABSTRACT

The automatic bag opening and slitting machine has a spike star wheels assembly comprising either of one or a combination of star wheels or cylindroid drum like object. The star wheels assembly is provided with spikes which convey a bag, impaled on the spikes when in an extended position, and extends beneath rotary cutting disks driven by two independent pneumatic or electric motors, that may make a continuous cut around three sides of the bag, so that after cutting thereof, the bag comprises two halves joined only at the rear or trailing side of the bag. These two bag halves are unfolded as one half of the bag engaged by the spikes is drawn around the upstream end of the star wheels assembly, while the other half slides over the rocker arm/bag separation bar/slide guide bar, thus emptying the powder/granular content of the bag into a hopper and releasing the emptied bag by retraction of the spikes from the bag for collection therebelow into a chute, for disposal into an endless screw which extrudes the bag into a compaction tube. The compacted bags are thereafter pushed into a waste plastic bag for refuse disposal.

19 Claims, 19 Drawing Sheets

AUTOMATIC BAG SLITTER, AND METHOD OF USE THEREOF

FIELD OF THE INVENTION

This invention generally relates to a bag opening machine of the kind which receives bags, in the form of sacks made from paper or sheet plastics material, and feeds them past means for cutting the bags to permit them to be opened for emptying.

BACKGROUND OF THE INVENTION

Many kinds of bag opening and emptying machine are known. Commonly encountered problems include the need to orientate and position the bags with some accuracy before presenting them to the cutting means. Also, an often occurring problem is that the bags accidentally retain at least some of their granular product material, after the cutting and opening thereof, on account of the way in which the bag is cut or subsequently manipulated for emptying, thus leading to inefficiencies due to waste.

Another drawback of prior art bag slitting machines, is that they are usually not suitable for food grade application, since in such applications, at least some of the entire bag conveyor assembly, cutter assembly and/or empty bag compactor, are exposed to the food during opening and emptying of the food material inside the bag, thus leading to high likelihood of contamination hazard of the food material from external contaminants before economical reclaim of the food material.

Moreover, known bag slitting machines usually cannot be washed or dried without any impurities left over. In particular, in prior art slitting machines, the male cam rollers enter and exit the full loaded bag slitting and emptying chamber, and slide over the stationary female cams, thus undesirably creating conditions for accidental contamination of the product released from the bag.

Also, existing designs of bag slitting machines are complex, including many nuts and bolts, gaskets, PVC belting, washers, and others, which increase the risk of maintenance downtime.

OBJECTS OF THE INVENTION

It is therefore an object of the present invention to provide a bag opening machine which overcomes, at least to some extent, the problems aforesaid. A further object of the present invention is to improve upon the bag opening machine disclosed in U.S. Pat. No. 4,504,183 issued Mar. 12, 1985 to JSK Company Ltd (inventors Stewart Bennison and Ronald Linnik).

SUMMARY OF THE INVENTION

According to the present invention, there is disclosed an automatic bag slitter preferably made of modular assemblies including: a spike star wheels assembly module, which can be slid in and out of the machine as one complete assembly; an infeed conveyor assembly module, which can be slid in and out of the machine as one complete assembly; a compactor module, which can be slid in and out of the machine as one complete assembly; and a vibrating screen and hopper module, which can also be slid in and out of the machine as one complete assembly.

The automatic bag opening and slitting machine has a spike star wheels assembly comprising either of one or a combination of star wheels or cylindroid drum like object. The star wheels assembly is provided with spikes which convey a bag, impaled on the spikes when in an extended position, and extends beneath rotary cutting disks driven by two independent pneumatic or electric motors, that may make a continuous cut around three sides of the bag, so that after cutting thereof, the bag comprises two halves joined only at the rear or trailing side of the bag. These two bag halves are unfolded as one half of the bag engaged by the spikes is drawn around the upstream end of the star wheels assembly, while the other half slides over the rocker arm/bag separation bar/slide guide bar, thus emptying the powder/granular content of the bag into a hopper and releasing the emptied bag by retraction of the spikes from the bag for collection therebelow into a chute, for disposal into an endless screw which extrudes the bag into a compaction tube. The compacted bags are thereafter pushed into a waste plastic bag for refuse disposal.

This invention provides more particularly a machine for opening, cutting and emptying bags filled with granular/powder material and the like. This machine comprises a conveyor in the form of a star wheels assembly equipped with a spike bar rotatably mounted thereon, the spike bar having integral spike members which can be extended radially outwardly from and retracted radially inwardly of the conveying surface of the star wheels assembly and means for feeding a bag to be opened and emptied to the star wheels assembly, which is arranged: (i) to convey the bag (impaled on the spikes thereof, when in their radially extended positions) to and past cutting means which act to make a continuous cut around three sides of the bag so that after cutting thereof, the bag comprises two halves joined only at the rear or trailing side of the bag; (ii) to allow the two halves of the bag to unfold as the half thereof engaged by said spike members is drawn to the forward end of the conveyor, thus enabling full emptying of the contents of the bag into receiving means therefor, and (iii) to release the empty bag (by retraction of said spike members) to collection means therefor.

This machine is characterized by the use of modular type spike conveyor assembly with single axle to which are journaled multiple star wheels, spacedly from one another.

A module is provided for cutting and emptying full loaded bags containing food products. A further module is provided for emptying bags wherein the material inside the bag is treated in a controlled and/or sanitary and/or aseptic environment, not excluding a negative pressure environment to prevent accidental release of hazardous material inside the machine, or positive pressure environment to prevent accidental ingress of contaminating external material. Also included is an improved bag cutting knife arm assembly, an improved cam design, an improved bag separation guide bar; and an improved modular type impaling spikes assembly.

More particularly, the invention relates to a bag opening and emptying machine for cutting bags inside a controlled environment bag slitting chamber, said machine comprising: a star wheels assembly, including rotatable integral shaft transversely carrying a set of star wheels spaced from one another, wherein a spacer gap is formed between each pair of successive said star wheels along said shaft, spike means mounted within corresponding said spacer gaps and extendible radially outwardly from and retractable radially inwardly of the periphery of said star wheels assembly, means for feeding a bag into the controlled environment chamber and onto a conveying surface of said star wheels assembly; means for extending said spike means radially outwardly of said star wheels assembly so as to impale the bag and firmly secure the latter to said star wheels assembly; cutting means adjacent the star wheels assembly past which the bag is conveyed in a conveying direction and which serve to make a continuous cut around three sides of the bag whereby the bag is cut into upper and lower halves hingedly joined at the rear or trailing side of the bag; the star wheels assembly serving to convey one half of the bag impaled on the spike means while the other half unfolds therefrom to release the contents of the bag, and defining peripheral quadrants; receiving means for collection of the contents of the bag, means for retracting said spike means to release the empty bag from the star wheel assembly, and collection means for the empty bag.

Preferably, the star wheels assembly is located beneath the path over which the bags travel during ingress from said means for feeding a bag and into said chamber, said star wheels assembly unfolding the two halves of the bag by drawing the half thereof engaged by said spike means over said star wheel assembly, and further including screen means to support the upper half of the bag as the bag is fed over the star wheels assembly and before it is drawn to follow the lower half around said star wheels assembly.

A number of radially outwardly opening notches could be formed at the periphery of each of said star wheels, and actuator rods each extending through registering said notches from corresponding successive said star wheels, said actuator rods cooperating with said spike means, with said means for extending the spike means, and with said means for retracting said spike means.

Said actuator rods could be rotatably mounted relative to said star wheels, and wherein said spike means are arcuate hooks, each of the latter having a sharp leading edge, said notches and associated actuator rods distributed on successive peripheral quadrants of each of said star wheels.

Preferably, said means for extending said spike means and said means for retracting said spike means consist of female cam means and resilient means urging said actuator rods to a position where the arcuate hooks protrude radially outwardly from the conveying surface, and a cam roller associated with each said actuator rod, each said cam roller cooperating with said female cam means such that the actuator rods are rotated against the action of said resilient means to retract said arcuate hooks and subsequently release said arcuate hooks at required positions in a closed loop. Said star wheels assembly could form a modular component slidably mounted in and out of the controlled environment bag slitting chamber, for facilitating maintenance thereof.

Said cutting means could include either two electric or two pneumatic drive motors spaced from one another, each of said motors driving a shaft carrying a rotatable blade, each drive motor supported into said chamber, each such motor, shaft and blade located in an operative condition thereof inside said chamber.

Alternately, said cutting means comprises two cutters which are arranged for movement inside said chamber in a conveying direction and laterally to said conveying direction to opposite sides respectively of said star wheels assembly, including resilient means which act to urge the cutters inwardly, one of said cutters being located behind the other in said conveying direction whereby each cutter engages each bag in cutting relationship in precisely the same position on the bag surface to ensure a continuous cut around three sides of the bag.

Each cutter may comprise a discoid cutting blade disposed in a plane parallel with an upper bag conveying surface of said star wheels assembly.

Preferably, there is further included air jet means mounted either in said star wheels assembly or in the rocker assembly, in closely spaced fashion relative to the downstream quadrant of said star wheels assembly and for engaging an inside surface of the bag as it is unfolded and emptied.

At least some of said spike means could include arcuate hooks, angled in said conveying direction and wherein said bag conveying surface of said star wheels assembly extends substantially horizontally and immediately downstream of said cutting means.

Preferably, said cutting means drive motors, shafts and blades form a unitary modular component slidably mounted in and out of said controlled environment bag slitting chamber, for facilitating maintenance thereof.

In one embodiment of the invention, a rocker type guide bar frame is pivotally mounted into a downstream portion of the controlled environment bag slitting chamber, said guide bar frame registering with said conveying surface of star wheels assembly and enhancing bag separation after said bag is cut by said cutting means, said rocker type guide bar frame forming a module releasably mounted into said chamber wherein maintenance of said guide bar frame is facilitated when released from said chamber.

Such guide bar frame could be selected from the group comprising a cross-sectionally triangular shape frame and a cross-sectionally T-shape frame, and preferably incorporating integral air outflow jet nozzles.

Preferably, said collection means for the empty bag consists of a bag collection chute, mounted beneath said star wheels assembly, and a powered endless screw system, operating within a compaction tube and pushing the empty bag away from said chamber toward a reclaim area, said endless screw system extruding the bag into another chute where the emptied bags are compacted and pushed into a waste plastic tube.

Said cam means could be a female cam groove, made into an anchor plate at one end of said star wheels assembly, said female cam groove engaged by said cam roller.

In one embodiment, said receiving means consists of a collection hopper, mounted into said chamber beneath said star wheels assembly, and a fine mesh screen, mounted within said hopper.

Preferably, there is further included means inducing high frequency vibration of said mesh screen.

Preferably, said guide bar frame includes a hollow elongated frame element having a series of lengthwisely spaced openings, the latter opening forming air outflow nozzles, and further including a pressurized air source feed means operatively connected to said guide bar frame element and enabling pressurized air ejection outwardly therefrom through said air outflow nozzles.

The invention also relates to a method of slitting open a bag with a bag opening and emptying machine of the above-noted type, wherein the method comprises the following steps: actuating said means for feeding a bag and feeding a bag into said chamber; actuating said means for extending said spike members and holding in position said loaded bags with the spike members from the spike star wheels assembly; actuating said cutting means that slit open the loaded bag with the cutting performed on three sides of the bag; rotating said star wheels assembly shaft in the conveying direction, when holding steady the bottom of the bag by the spike members, while drawing the bag around the star wheels assembly, wherein the bag is turned inside out and the material inside the bag is discharged by gravity; sifting the material from the bag; and compacting the emptied bag.

BRIEF DESCRIPTION OF THE DRAWINGS

FIGS. 18A to 18E sequentially show in plan view how the spring biased knife assembly pivot arms pivot during passage of a bag G through the cutting section A; and FIGS. 19A to 19E are views similar to FIGS. 18A to 18E, respectively, but in elevational views.

DETAILED DESCRIPTION OF THE PREFERRED EMBODIMENT OF THE INVENTION

Figure 1:
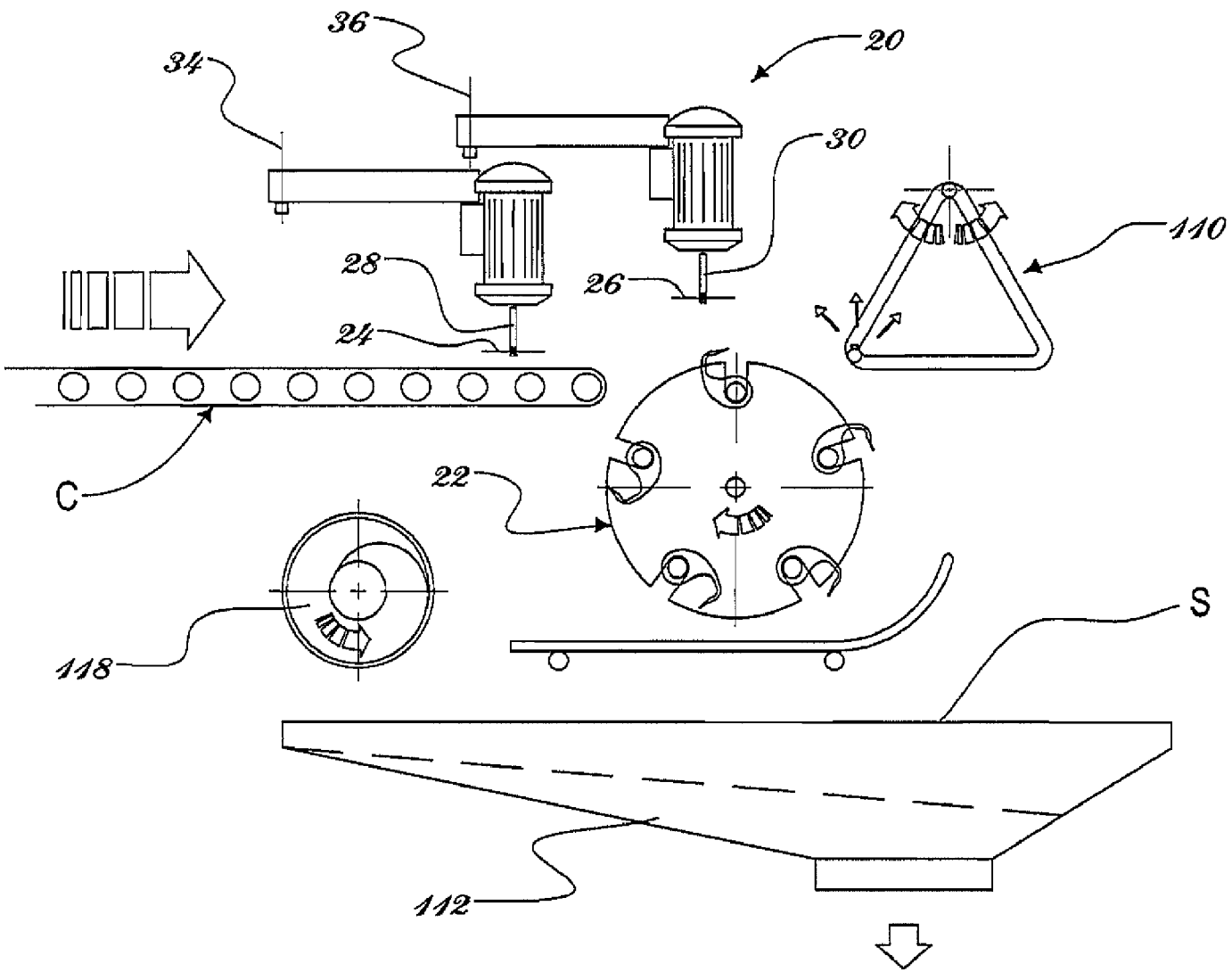
FIG. 1 is a schematic side elevational view of a preferred embodiment of automatic bag slitter according to the invention.
Figure 2:
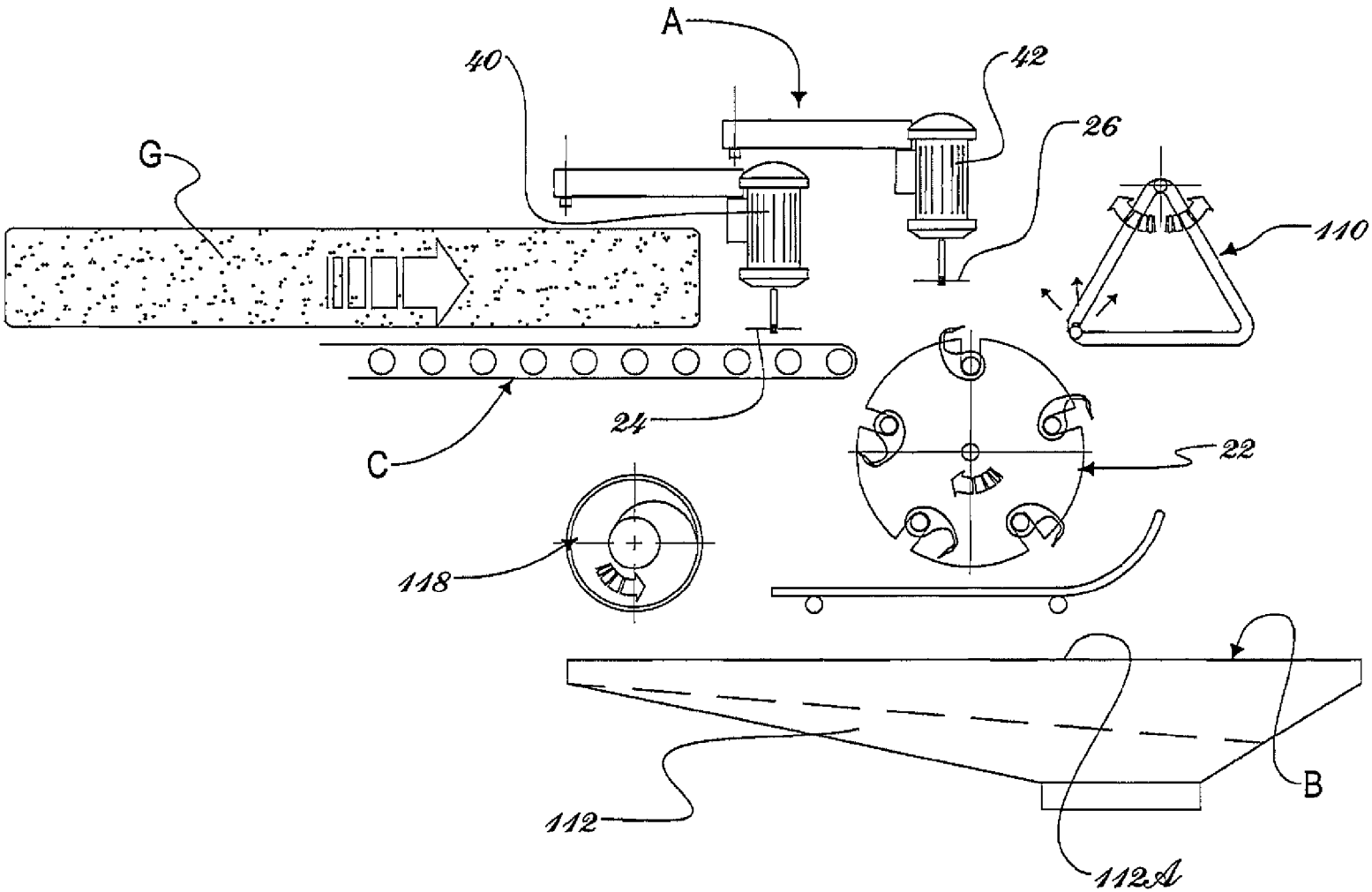
FIGS. 2, 3, 4 and 5 are schematic side elevational views suggesting the sequence of operation of the automatic bag slitter from feeding, slitting and product discharge to slitting and compaction.
Figure 3:
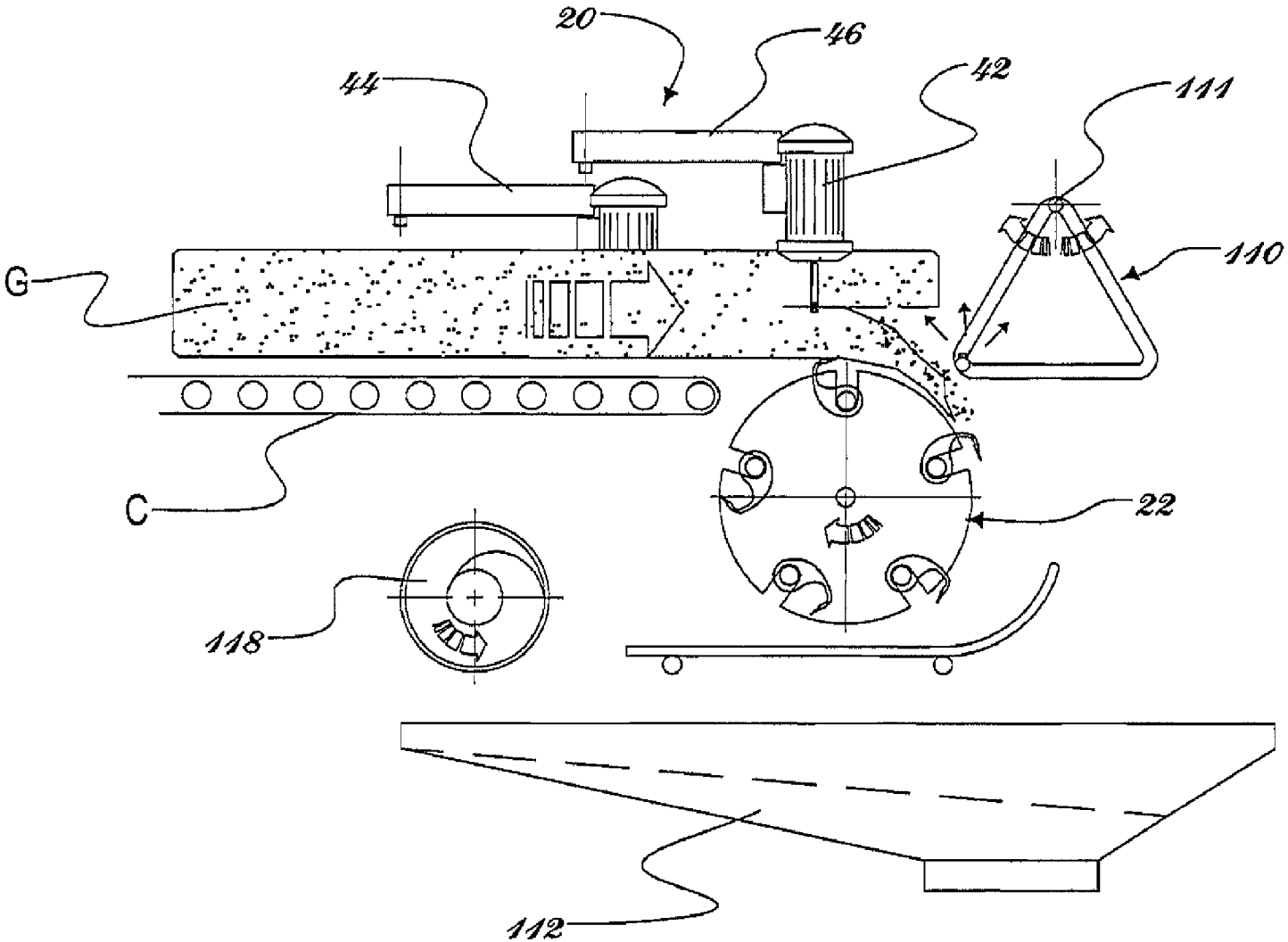
Figure 4:
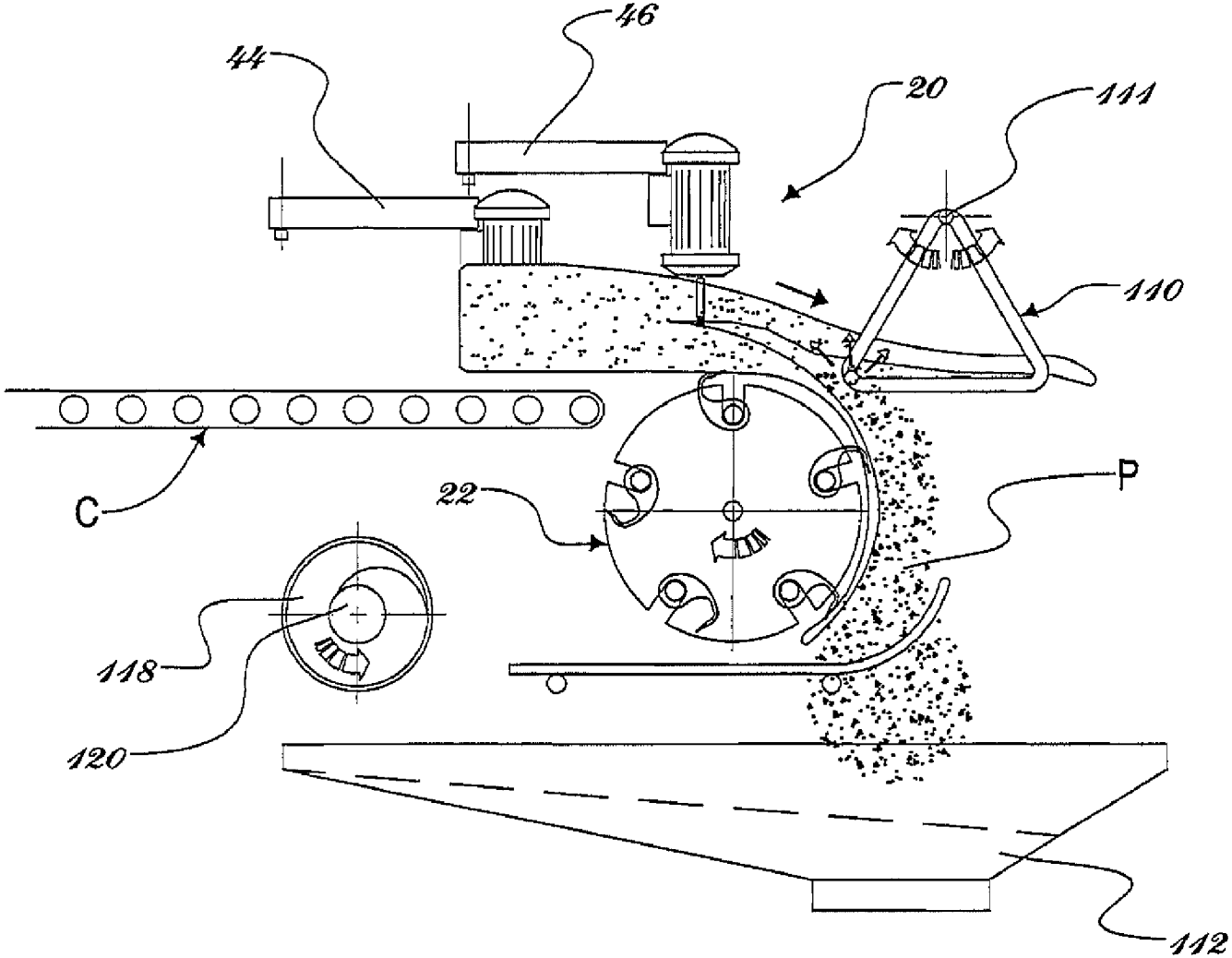
Figure 4B:
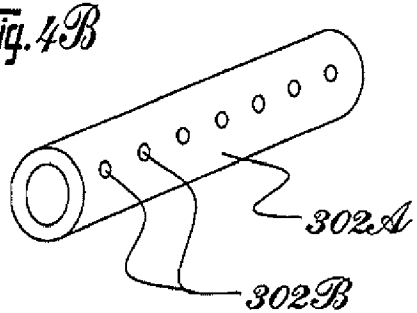
FIG. 4B is an enlarged perspective view of this air outflow cleaning means.
Figure 4A:
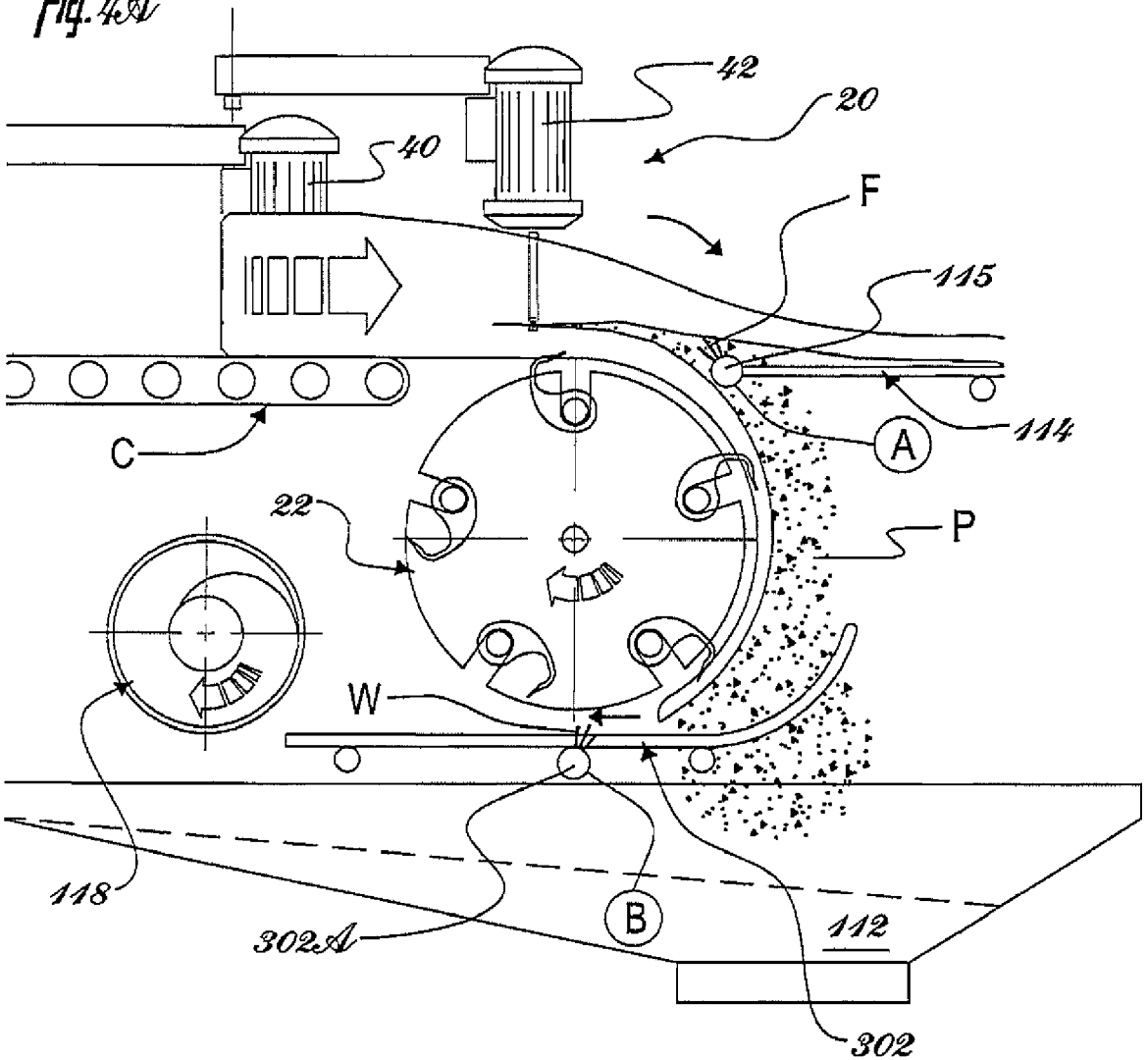
FIG. 4A is an enlarged view of the right hand side of FIG. 4, showing an alternate embodiment of the invention with the grate beneath the star wheels assembly comprising a pressurized air outflow cleaning means.
Figure 5:
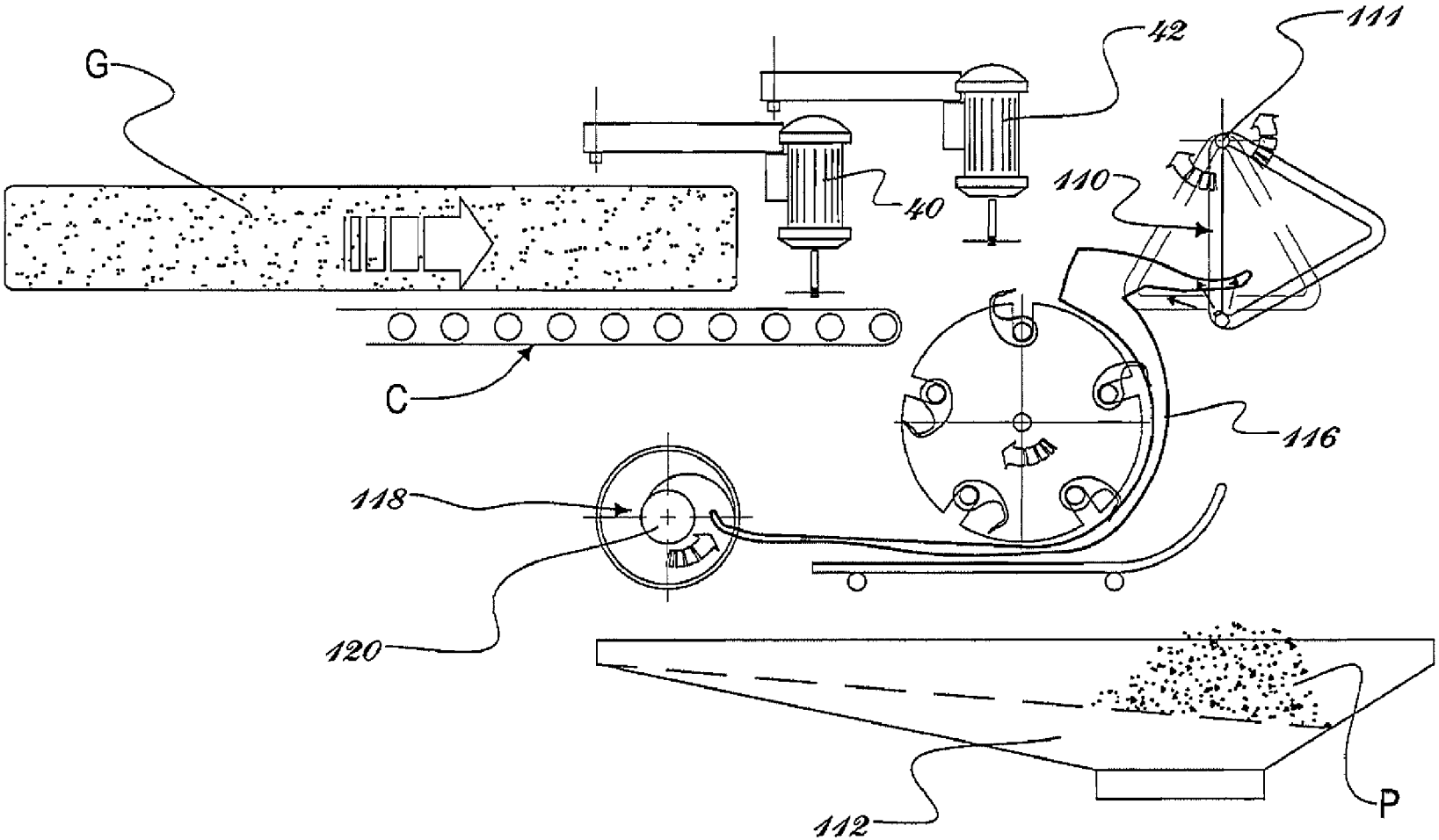

Referring to FIGS. 1 to 5 of the drawings, it will be seen that full bags G (containing powder or granular material) to be opened and emptied are fed into the automatic bag slitting machine 20 by an infeed roller conveyor C, which transfers them to a spiked star wheels assembly 22, which carries them through a cutting station, generally indicated at A, and to an emptying station, generally indicated at B. Precise positioning and orientation of the bags on conveyor C and of star wheels assembly 22 is not required as will become apparent hereinafter. At the cutting station A are two rotatable cutting blades or discs 24 and 26, disposed in a common horizontal plane and mounted for rotation on vertically extending shafts 28 and 30 respectively, rotatably driven in direct drive by motors 40, 42, respectively. Motors 40, 42 are preferably pneumatic (air driven), while not excluding as alternate embodiment electric motors 40', 42' (FIG. 11), and are carried by L-shape arms 44 and 46 for relative movement about bearing mounts 34, 36, journaled into a registering wall section of the large housing 32 (FIGS. 14-15) enclosing the present machine components. Pneumatic type motors 40, 42, are preferred, in particular in case the bags G enclose foodstuff or hazardous (e.g. inflammables or explosives) powder or granular material.

Conveyor C has an inner portion, extending into the machine housing 32, and an external portion, extending outwardly from the machine housing 32. As illustrated, the downstream end portion of bag conveyor C comes in generally vertical register with the overhanging cutting station A, closely spaced from the top section of star wheels assembly 22. Also, downstream cutter 26, 42, comes in vertically overhanging register with the top surface of star wheels assembly.

Aims 44 and 46 are free to turn about the axes of the bearing mounts 34, 36. The arms 44 and 46 are urged inwardly and rearwardly by resilient tension spring means 400 (see FIGS. 16 to 19E, and as generally disclosed in prior art U.S. Pat. No. 4,504,183, supra), to position the cutting discs 24 and 26 substantially centrally of the path along which the bags G are conveyed by the conveyor C and star wheels assembly 22. Tension spring means 400 preferably consists of piano wire, air cylinder, or gas spring means. Spring means 400 keep knife pressure on the bag G as the bag advances through the cutting station A, wherein the knives 24, 26, cut the bag G. As bag G clears cutting area A, spring means 400 bring cutters 24, 26 into their initial unbiased condition of FIG. 2, in spring back fashion. Most importantly, one of the support arms, here 46, is positioned downstream of the other (upstream) arm 44, for reasons which will be discussed hereinafter.

Figure 7:
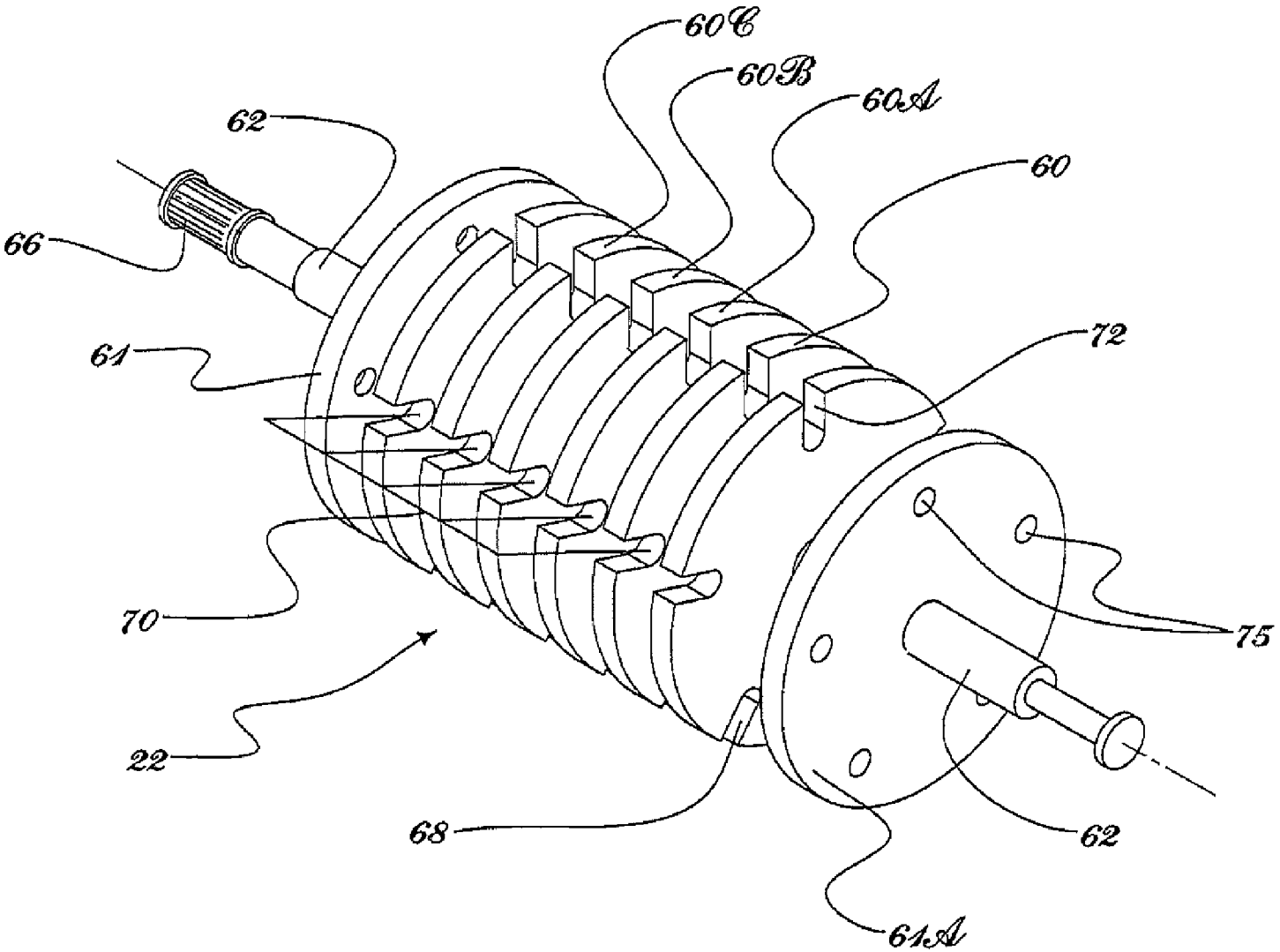
FIG. 7 is a perspective view of the spike star wheels assembly forming part of the present invention.
Figure 10:
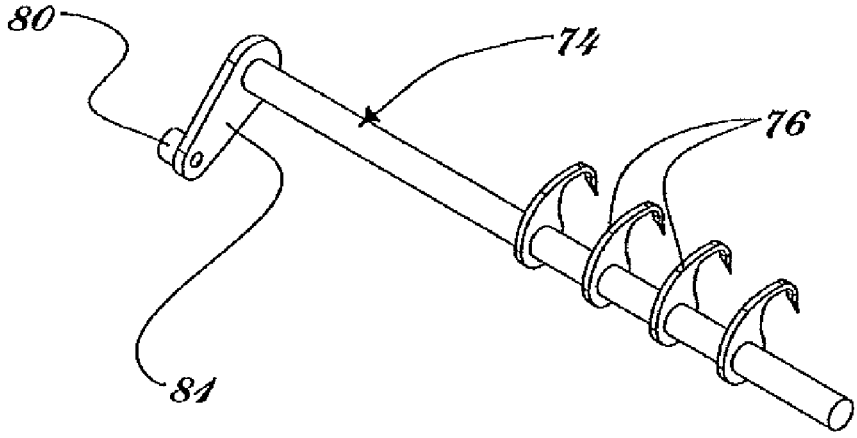
FIGS. 10 and 10A are perspective views from two different perspectives of the spike bar assembly.

Referring now to FIGS. 7 and 10, it will be seen that the star wheels assembly 22 is formed from a number (for example six) of transversely extending star wheels 60, 60A, 60B, . . . transversely journaled by a single shaft 62. Two anchor plates 61, 61A are transversely fixedly secured to opposite ends of shaft 62 spacedly from the star wheels. Shaft 62 is supported at opposite ends by bearing mounts 63 on two opposite upright walls 32A, 32B (FIG. 15) of the present machine housing 32 enclosing the controlled environment bag cutting chamber 67.

Figure 15:
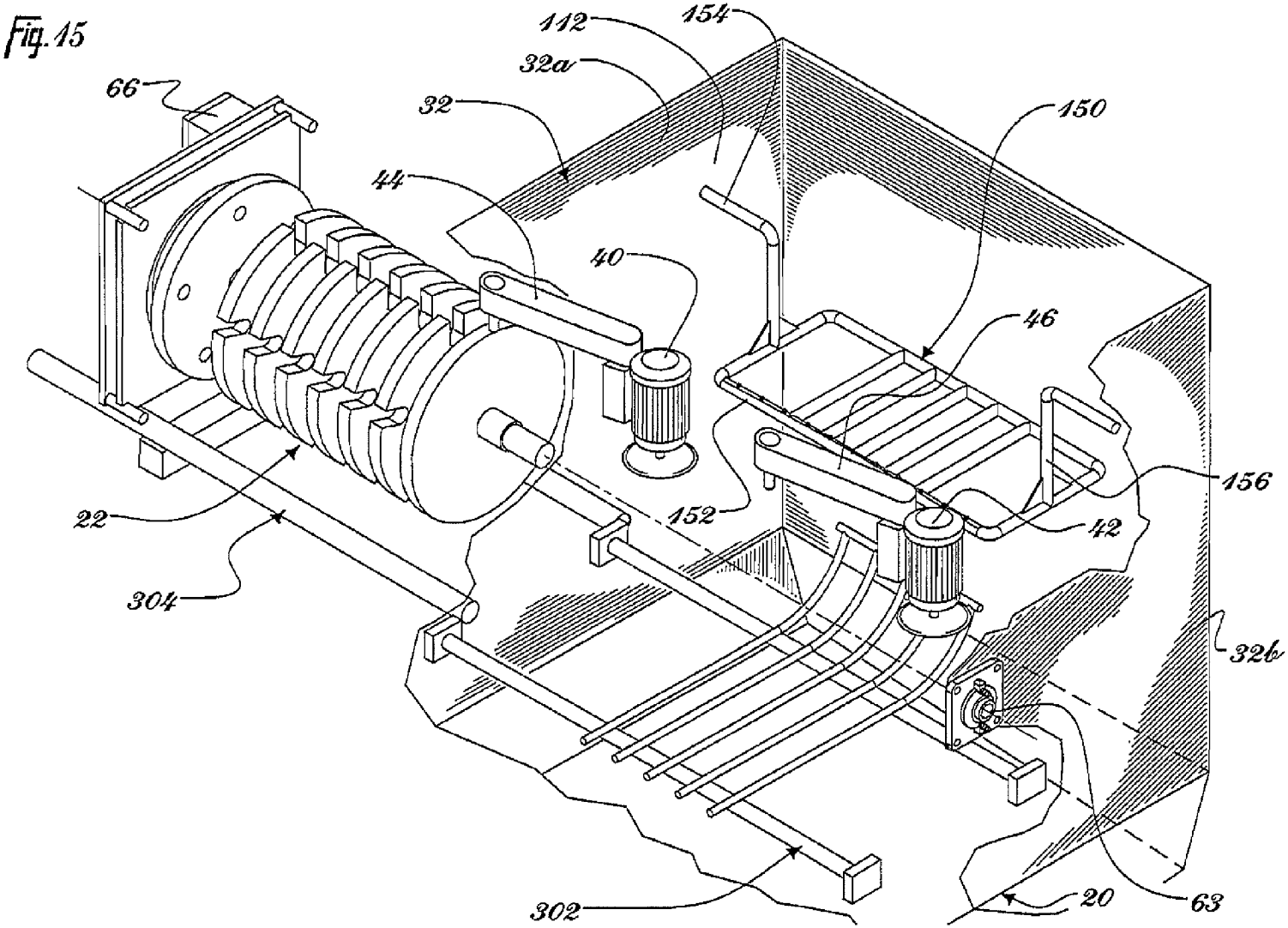
Figure 17:
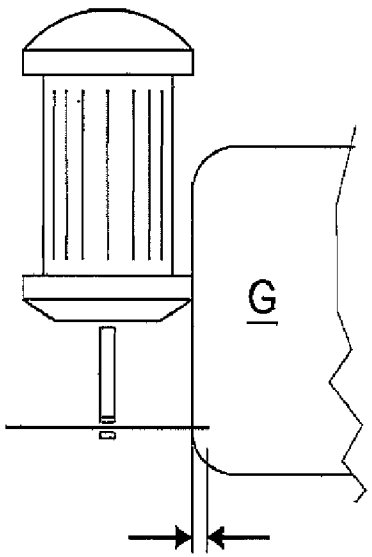
FIG. 17 is an elevational end view of the components of FIG. 16.
Figure 16:
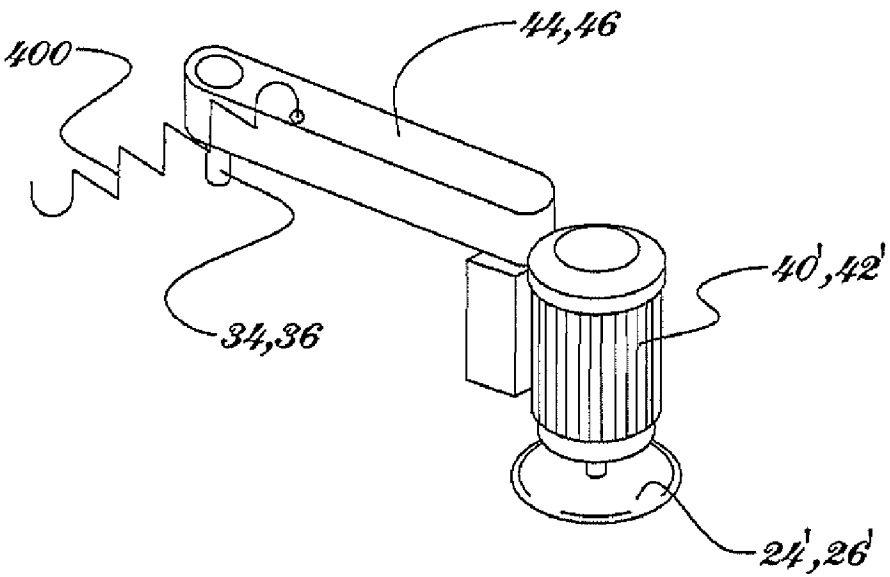
FIG. 16 is a view similar to FIG. 11, but further showing the spring means biasing the knife assembly support arm.
Figure 18C:
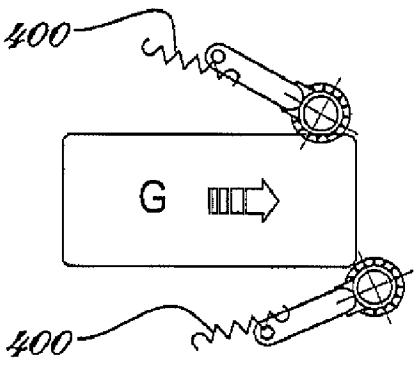
Figure 18B:
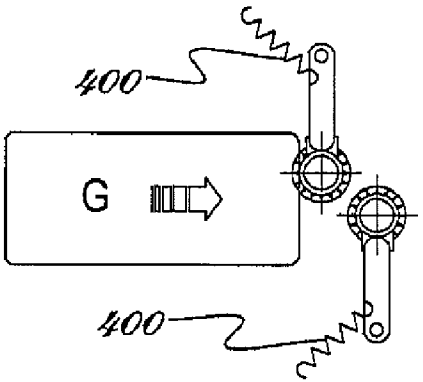
Figure 18A:
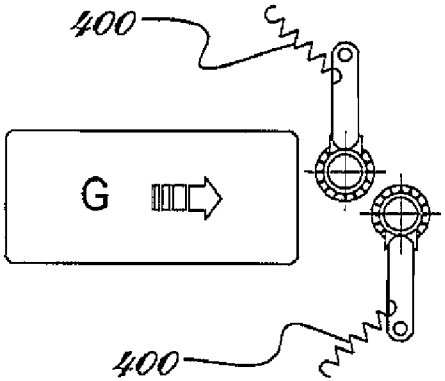
Figure 19C:
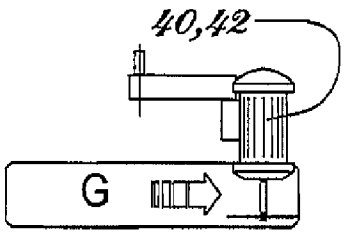
Figure 19B:
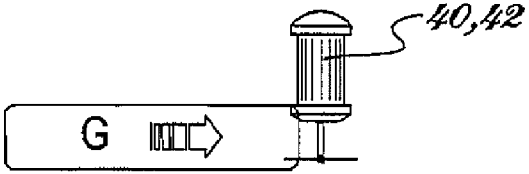
Figure 19A:
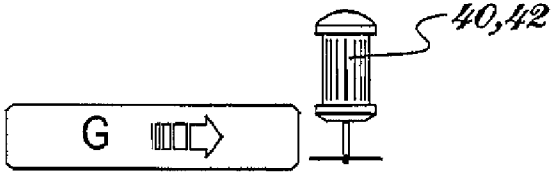
Figure 18C:
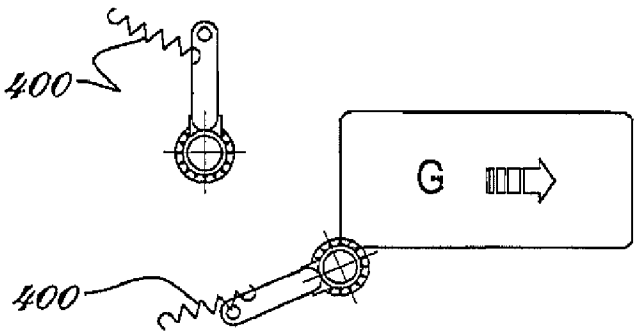
Figure 18D:
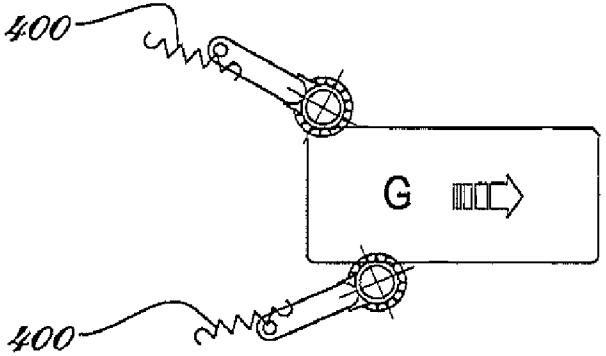
Figure 19C:
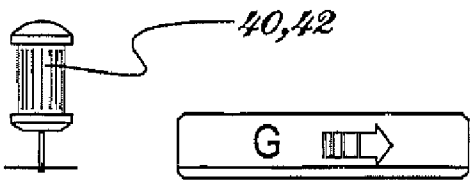
Figure 19D:
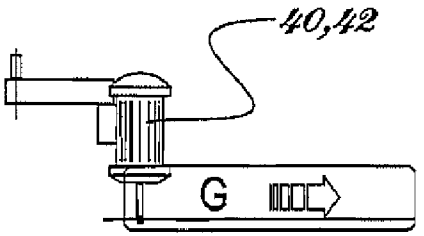

Shaft 62 is directly driven by a gear reducer motor 66 (FIGS. 7 and 15). Each star wheel 60, 60A, . . . is rotatable with shaft 62 and a few (for example five) radially outwardly opening notches 68, 70, 72, . . . are formed radially outwardly of each discoid star wheel 60, 60A, . . . Each of the notches 68 of star wheels 60, coaxially register with one registering notch 68 for each of the other star wheels 60, 60A, so that a spike bar 74 can extend transversely through all star wheels 60 axially of notches 68 and generally parallel to star wheel shaft 62. Thus, corresponding number of spike bars 74 engage corresponding sets of notches 68. Spike bars 74 are rotatably carried at opposite ends into cavities 75 made in the anchor plates 61, 61A. A number (for example four) arcuate spikes 76, 76A, 76B, . . . are integrally carried in lengthwisely spaced fashion to each spike bar 74. Spikes 76 are sized to fit in the spacing gap between each corresponding successive pair of star wheels 60, 60A, . . . and to be rotatable independently of the star wheels between a first limit position, nested within this inter star wheel gap and thus clearing the radially outward periphery of the star wheel (steps 4 and 5 of FIG. 9) and a second limit position (steps 1 to 3 of FIG. 9) where the elbowed sharp edge tip portion thereof 77 projects radially outwardly of the star wheel 22. The leading tip portion 77 (FIGS. 8-9) of the spikes 76 is directed toward the bag conveying direction.

Figure 10A:
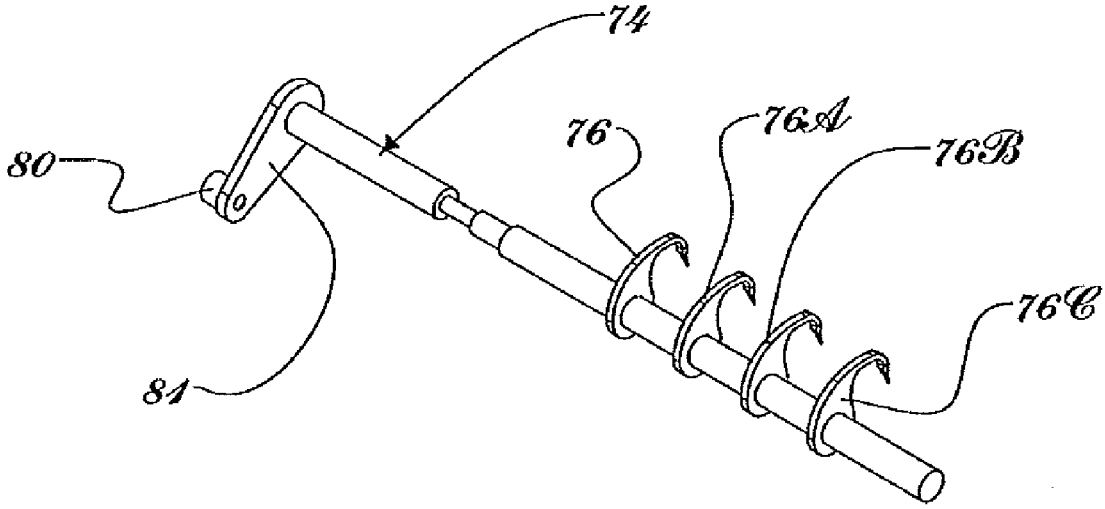

To the outer end of each spike bar 74 is transversely mounted a lever 81 (FIGS. 10, 10A). Lever 81 carries a cam roller 80 opposite spike bar 74. In an alternate embodiment, cam roller 80 is replaced by a cam follower (not shown). Spike bar 74 is provided endwisely with a cam roller 80, it is rotatable independently of and relative to star wheel 60. Cam means 83 are formed by the interplay of lever 81, cam roller 80 and a female cam groove 65 in anchor plate 61.

It is understood that cam means 83 allows the elbowed sharp tip portion 77 of spikes 76 to spring outwardly to impale the bags at the downstream end of the star wheels assembly 22.

The automatic bag slitter 20 is designed to slit open and empty full bags G containing different types of material, in particular granular or powder material, food, feed, chemical and other product, hazardous or non-hazardous, explosive or non-explosive, packaged in paper bags, plastic bags, poly-woven bags, burlap bags, jute bags and other packages in bags or boxes.

As shown in FIGS. 2 to 5 of the drawings, the sequence of operation of the present machine is as follows:

a. feeding

An operator loads the full bags G (loaded with powder/granular material) onto the infeed conveyor C which convey the loaded bags to the spike star wheels assembly 22, where the bags are spiked and held in position during the slitting cycle.

b. slitting

The two rotary cutting blades 24, 26, automatically adjust to the different full loaded bag sizes and neatly slit the full bag G on three sides for a thorough gravity discharge of the product content thereof inside the bag.

c. product discharge

The bottom of the emptied bag, G', is firmly held by the spikes 76 and is drawn around and under the spike star wheels assembly, in one long sheet. In the process, the empty bag G' is turned inside out and the product P is discharged by gravity. Empty bag G' engages a bag separation guide rocker 110 (FIG. 13A), which starts to tilt in a downstream downwardly oriented direction.

d. Sifting and compaction

Figure 6:
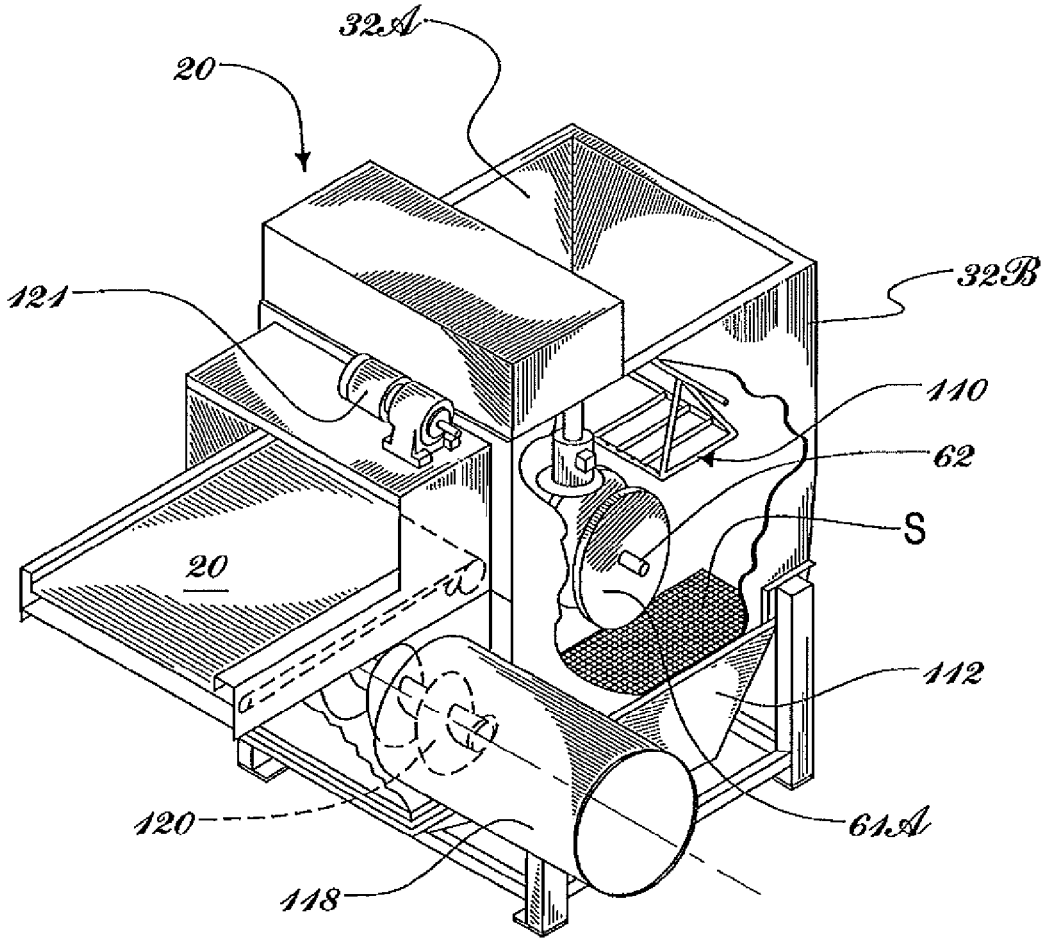
FIG. 6 is an exploded view of selected components of the present bag slitter.

Any remaining residue of product P accidentally clinging to the interior surface of the envelope of emptied bag G' is removed by a blast of air jet from a pressurized air source (not shown). Oversized foreign particles are sifted on a fine mesh screen S (FIG. 6) in the collection hopper 112, which is preferably vibrated at high frequency. Spikes 76, 76A, . . . are retracted and the emptied bag G' extruded via the compactor into a dust-free, plastic waste receiving bag. Bag separation guide rocker 110 tilts away about pivot 111 from spike star wheels assembly 22, guiding spent bag G downwardly along the downstream and bottom quadrant periphery of the star wheels assembly 22, clearing the top mouth 112A of hopper 112, toward an empty bag collector compactor chute 118 equipped with an endless screw 120 powered by motor 121 (located outside of chamber 32) for remote reclaim.

More particularly, in use, bags G are fed by the infeed conveyor C towards the rotatable star wheels assembly 22. As successive rows of spikes 76, 76A, . . . approach the underside of bags G so conveyed, the spikes they are radially outwardly tilted by disengagement of the earn rollers 80 from the female cam groove 65 to impale themselves through the bag G under the action of torsional springs (not shown) and carry the bag forwardly through the cutting station A. Alternately, the position of male/female cam rollers 80/grooves 65 could be inverted, without affecting the scope of the present invention.

The bag G thus encounters the upstream cutting disc 24 which penetrates the bag envelope and which is then forced laterally by continued progress of the bag G to cut half of the leading edge of the bag and down one side of the bag. Shortly thereafter, the upstream cutting disc 24 has begun to move laterally, the bag G is brought into engagement with the downstream cutting disc 26 at precisely the same position as the upstream cutting disc 24 first contacted the bag. In similar manner, the downstream cutting disc 26 is forced forwardly and laterally by continued progress of the bag to complete the cut through the leading edge of the bag and down the other side of the bag. As the bag G' reaches the downstream quadrant portion of the spiked star wheel assembly 22, the lowermost portion of the envelope of the bag which is securely impaled on the spikes 76 is pulled downwardly from the remainder of the bag G' which is supported as it is fed over the star wheels assembly before it is drawn downstream to follow the lower part of the bag by a rocker type bag separation guide bar assembly 110 (see also FIGS. 15A and 15B) spacedly overlying a collection hopper 112 into which the contents of the bag fall. The envelope of the bag G' is conveyed by the spiked star wheels assembly 22. The bag envelope is conveyed downstream and released from the spiked star wheels assembly 22 by retraction of the spikes 76, to fall into bag collection chute 118 equipped with powered endless screw 120 which serves to compact and convey the empty bag G to suitable disposal means, such as a collection sack or the like.

Since the length of the empty bag G' where it is removed is twice that of the uncut bag, the infeed conveyor C is arranged to run at such an adjustable speed as to be suitable for different applications/constructions/configurations of the bag G' to match the star wheels assembly 22, whereby the machine will be able to handle, without interruption, a continuous supply of bags from the infeed conveyor C.

The cutter station shafts 28 and 30 are preferably adjustable as to height relative to the arms thereof 44 and 46, to enable the machine to be set up to deal with bags of different size. Clearly, the cutting discs 24 and 26 should always be at the same horizontal plane level to ensure that they each engage the bag G in turn at an identical position to ensure a continuous cut around the bag, facilitating the full emptying of its contents as the undersurface of the bag envelope is peeled from the remainder at the emptying station.

FIG. 7 shows the present improved spike conveyor assembly comprising the following features:

- the series of star wheels 60 manufactured out of plastic or sheet metal, aligned in series and the drive shaft 62 axially carrying all of these star wheels;
- The two anchor plates 61, 61A transversely carrying the opposite ends of the spike bar 74, wherein five or more spike bars 74 are used and anchored by the two anchor plates 61 on both opposite ends thereof;
- The drive shaft 62 carrying the entire spike star wheels assembly 22 is driven directly by a gear reducer motor 66. There are no nuts, bolts, gaskets or belting material used anywhere in the spike star wheels assembly, which is exposed and in direct contact to the product;
- such a design is especially designed for food, feed, chemical or other powder or granular product which is packaged in any form of bag.

Figure 8:
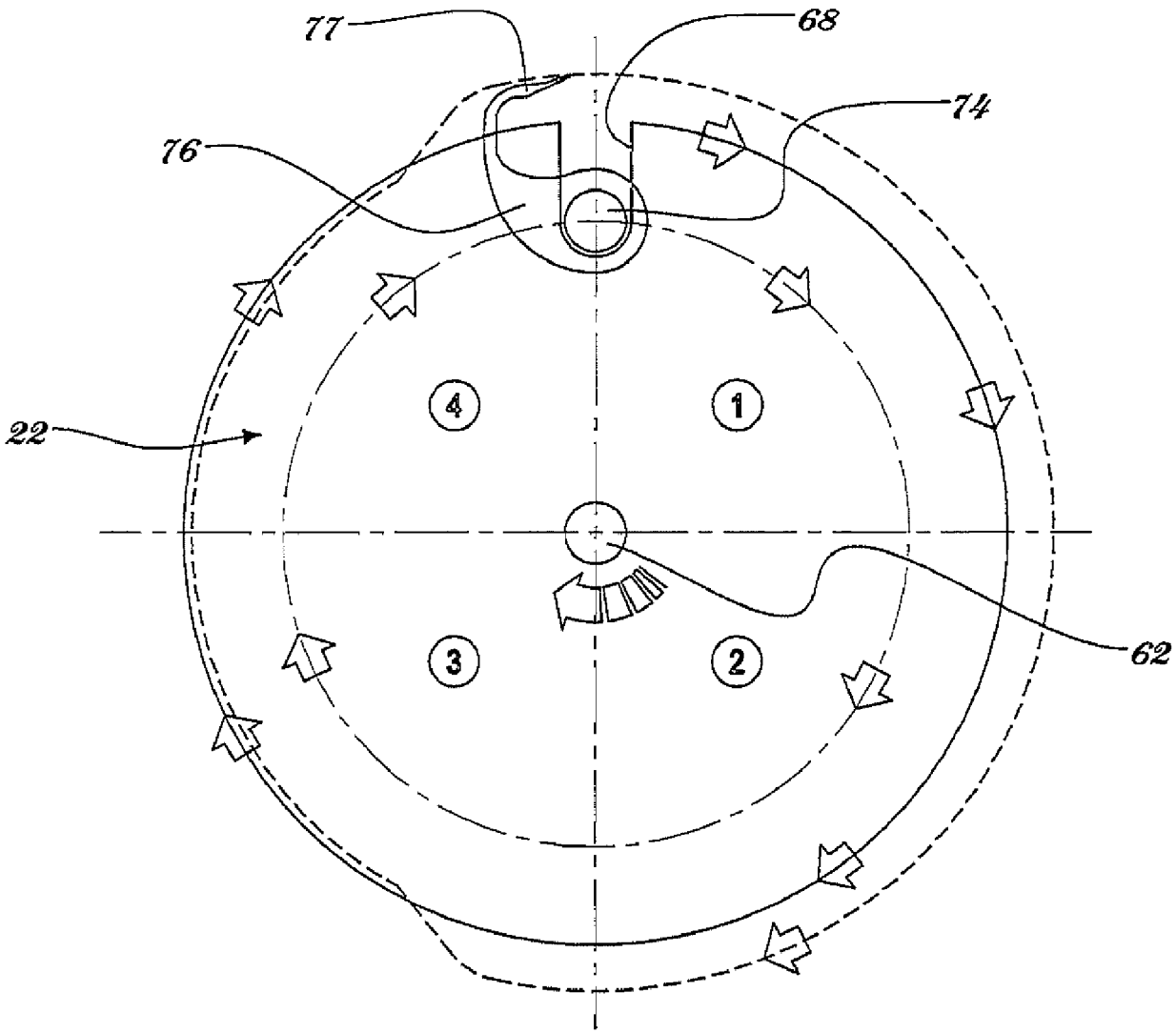
FIGS. 8 and 9 are plan views of a single star wheel from the star wheels assembly, sequentially showing the radially outwardly mounted spike movement during one complete rotation cycle of the star wheels assembly.
Figure 9:
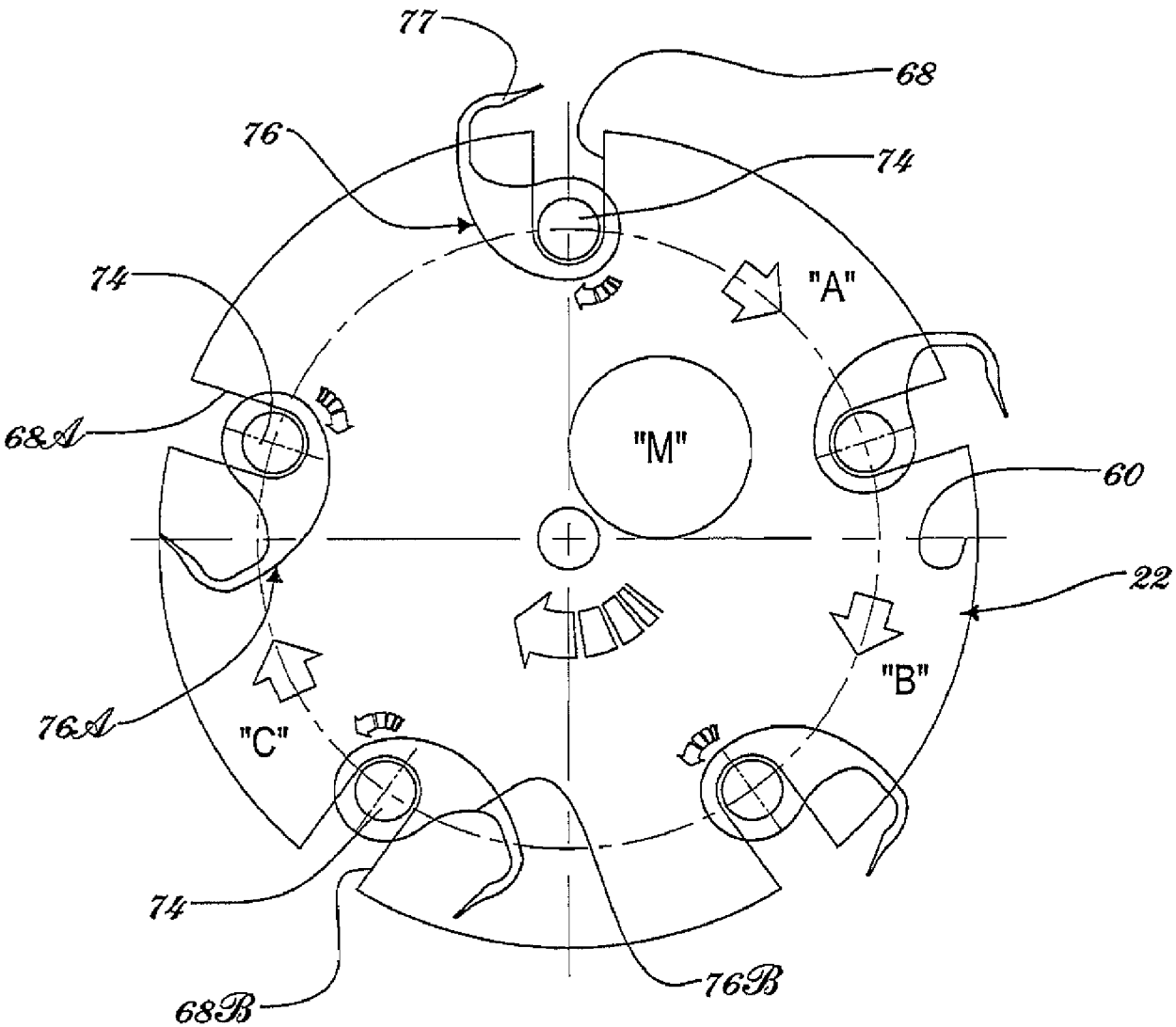

FIGS. 8 and 9 illustrate the travel path of a single spike 76 as the star wheels assembly 22 rotates with its shaft 62 through one full turn by going through four successive quadrants of the star wheels assembly. The improved automatic bag slitter 20 is strictly based on the engineering theory explained below. This theory applies to the spike star wheels assembly 22 and its operation through one complete rotation and the repeatability function for continuous operation with minimal expected downtime. The spike movement during one complete rotation cycle of the star wheels assembly 22 is schematically shown in these figures.

The spike star wheels assembly 22 rotates clockwise using its shaft 62 as the centre point; the spike bars 74 and their orbital path follow arrows ABC (spike shaft assembly travel) as shown in FIG. 9. The cam rollers 80 (FIGS. 10, 10A) engage and follow the stationary groove or female cam, 65, in anchor plates 61, and provide the trajectory for the travel of spike sharp elbowed tip 77.

The sequence is as follows:

Step 1: the spike bar 74, during its travel in the fourth upper downstream quadrant of star wheels assembly 22 as shown above, penetrates into the bag G by rotating on its own axis. The driving force is provided by the cam action of cam means 83 (components 80, 81, 65).

In an alternate embodiment of the invention, an external torsional spring (not illustrated) can also be used instead of/or in combination with the cam means 83. During this time, the bag G is spiked and held in position during the slitting cycle.

Step 2: the spikes 76 retain their position from a 12 o-clock position to a 3 o'clock position via the same upper downstream quadrant of star wheels assembly 22. During this time, the rotary cutting blades automatically adjust to different bag sizes and neatly slit open the bag on three sides only for a thorough gravity discharge of the product. The spikes 76 hold the bottom half of the bag during the product separation and discharge from the bag.

Step 3: the spikes 76 retain their position from a 3 o'clock position to a 6 o'clock position in lower downstream quadrant of assembly 22, without turning on their own axis 74, during which time the bottom of the bag G' is firmly held by the spikes 76 and is drawn around under the spike star wheels assembly 22 in one long sheet. In the process, the bag is turned inside out and the product is discharged by gravity.

Step 4: the spikes 76 turn on their own axis 74 and retract radially inwardly back in from the star wheels assembly 22 and release the empty bag for compaction or disposal in the third lower upstream quadrant of assembly 22. It should be noted that the star wheels assembly 22 top tangential surface is then used as a support base while the spikes 76 are retracted.

Step 5: in the upper upstream quadrant of star wheels assembly 22, the cycle of extension/retraction of spikes 76 is repeated, and continue for the next full turn.

In FIG. 10, it is understood that in the improved spike bar assembly, the spike bar 74 is a rod or a bar or a tube. Spikes 76 project radially outwardly from bar 74, and are welded to the rod 74 or bar or tube. At one end of the bar 74, lever 81 carries cam roller 80. Inside the machine 20, only the spikes 76 and the spike bar 74 are exposed, thus there is no hardware used. Inside the machine 20, the spike bar 74 is totally washable. The bar 74 could also be made out from plastic or polymer and/or other metal.

Figure 11D:
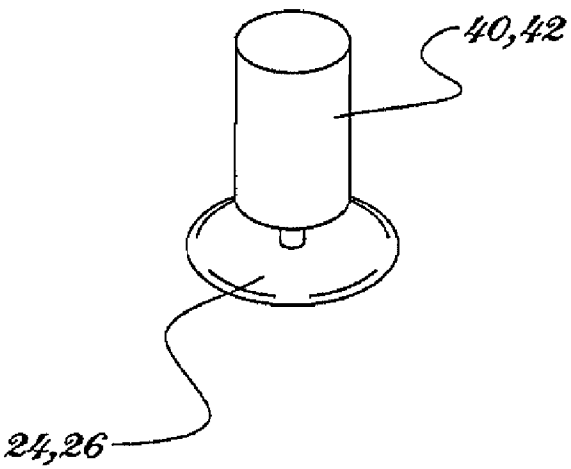
FIGS. 11 and 11A are perspective views of an electrical and a pneumatic type motor, respectively, and rotating blade cutting assembly for two bag cutter station embodiments of the invention.
Figure 11:
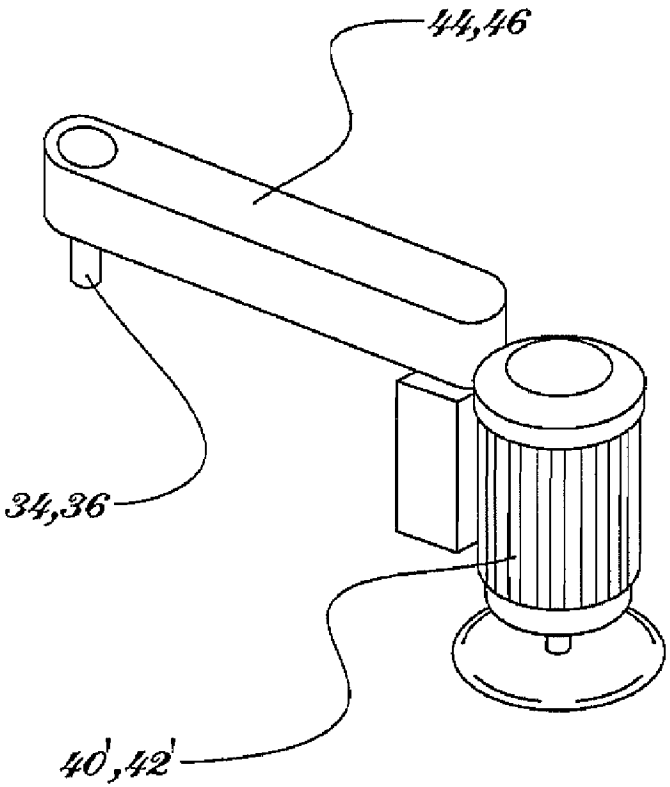

In FIGS. 11-11A, the improved knife assembly comprises an electric motor 40, 42, mounted directly to the knife arm 44, 46. According to an alternate embodiment of the invention, donuts may be used to follow the contour of the full loaded bags. Alternately, and preferably, pneumatic (pressurized air) driven motors 40', 42', may be used (replacing electric motors 40, 42). The entire system is completely washable. The system is safe enough to be usable for food grade applications, although non foodgrade applications are not excluded.

Figure 12:
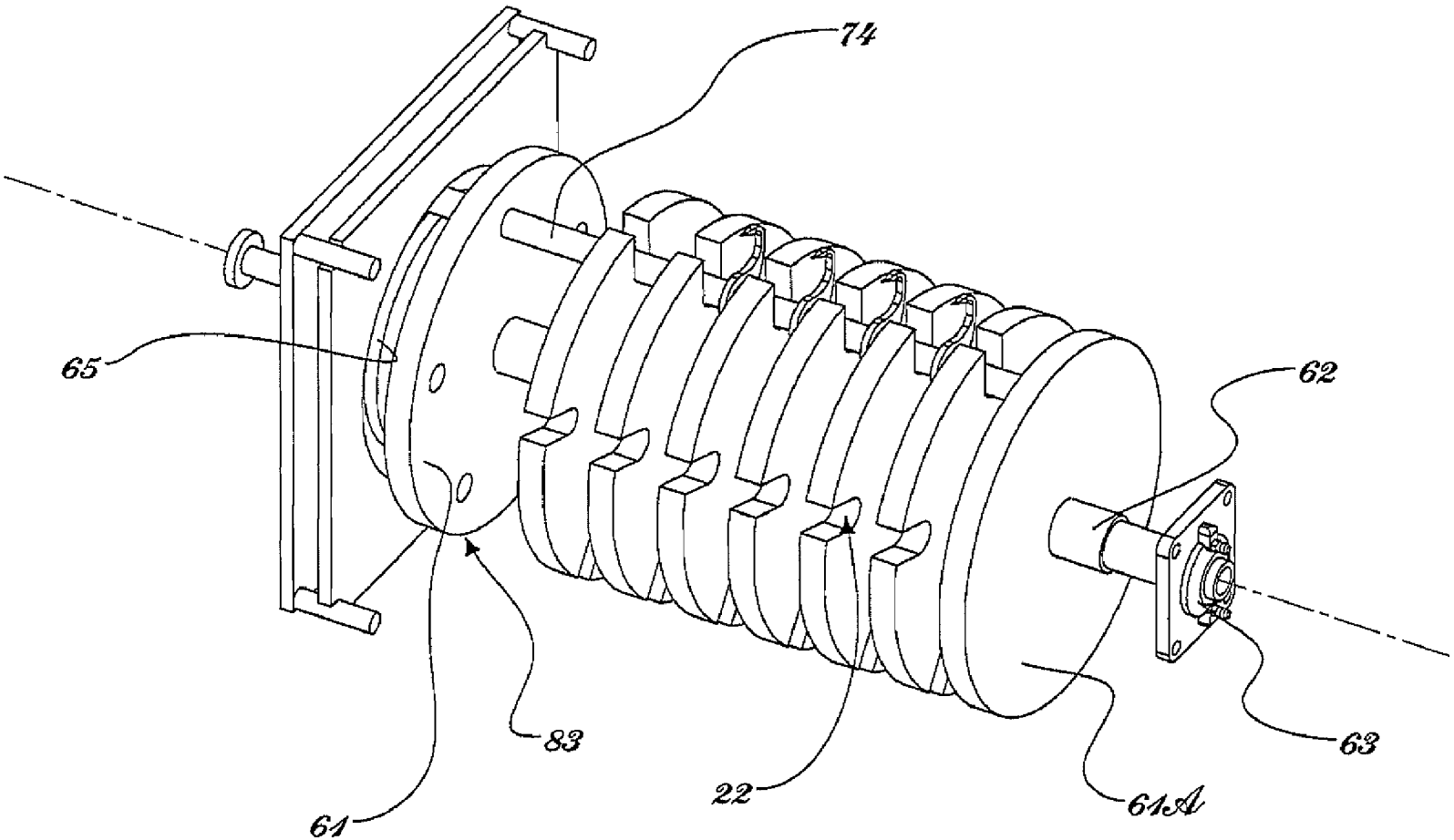
FIG. 12 is a view similar to FIG. 7, but modified to more clearly show the present invention cam design.

In the improved cam design of FIG. 12, the cam means 83 is made from cam roller 80, lever 81, and a female cam or groove 65 made in fixed anchor plate 61. Cam means 83 projects outside of the bag cutting and emptying chamber inside the housing 32 enclosing the bag slitting and emptying chamber 20. Cam means 83 is thus an integral part of the spike star wheel assembly 22, but externally located relative to the controlled environment bag cutting and emptying chamber 32. The (male) cam rollers 80 thus engage and follow the (female) cam groove 65 and provide a full rotational capability. All of the cam assembly 83, is entirely located outside of the bag slitting and emptying chamber, and thus provide a completely safe food grade environment for food applications if required, without the hazard of accidental food product contamination when the bag is opened.

In an alternate embodiment of the invention, torsional springs (not shown) may be used to drive the spike in addition to/or as a replacement of the force given by the path of the cam means 83.

Figure 13D:
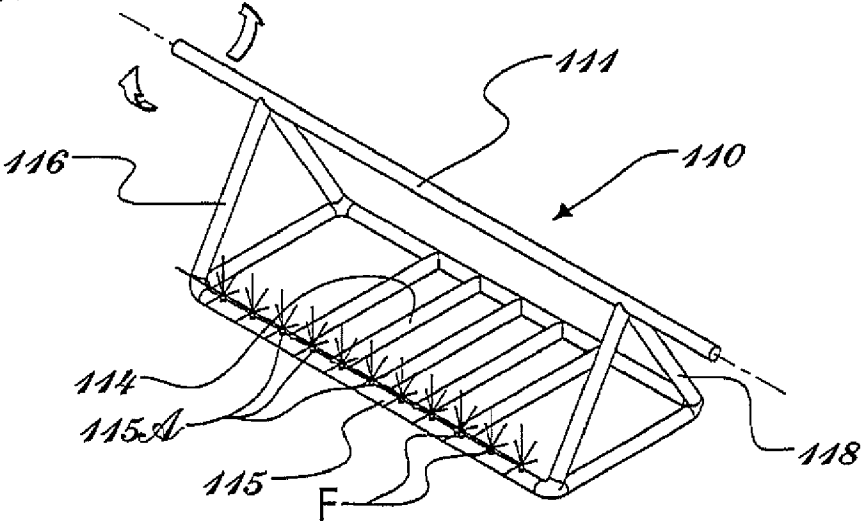
FIGS. 13A and 13B are schematic perspective and side elevational views respectively of a first embodiment of the guide bar assembly of the invention.
FIG. 13C is a side elevational view of a second embodiment of guide bar assembly.
Figure 13C:
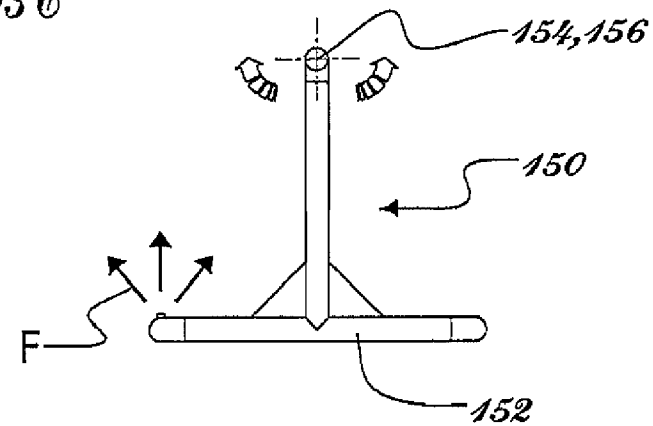
Figure 13B:
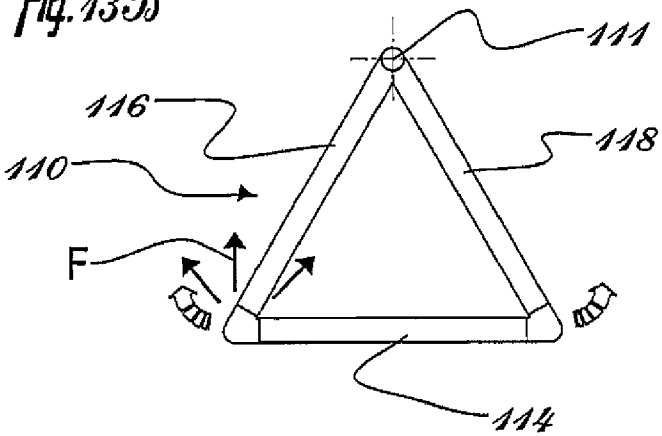

The improved guide bar assembly 110 shown in FIG. 13A, is one single complete component manufactured without any hardware or springs. A rocker bag separation guide bar 111 is pivoted at the opposite upright walls 32A, 32B of the machine housing 32. A flat grate 114 is fixedly mounted to pivotal guide bar 111 by two pairs of opposite inversely V-shape brackets 116, 118. The whole guide bar assembly 110 can be removed very easily from housing 32, and cleaned and washed. Guide bar assembly 110 is preferably manufactured out of carbon steel, stainless steel, or plastic/polymer; and out of tubing, bars or rods. Grate 114 includes an upstream elongated hollow tube 115 having a number of lengthwisely spaced bores 115A. A pressurized air source is fluidingly connected to tube 115, for providing air outflow at F. Air flow F cleans passing bags G, as suggested in FIG. 4.

Figure 14:
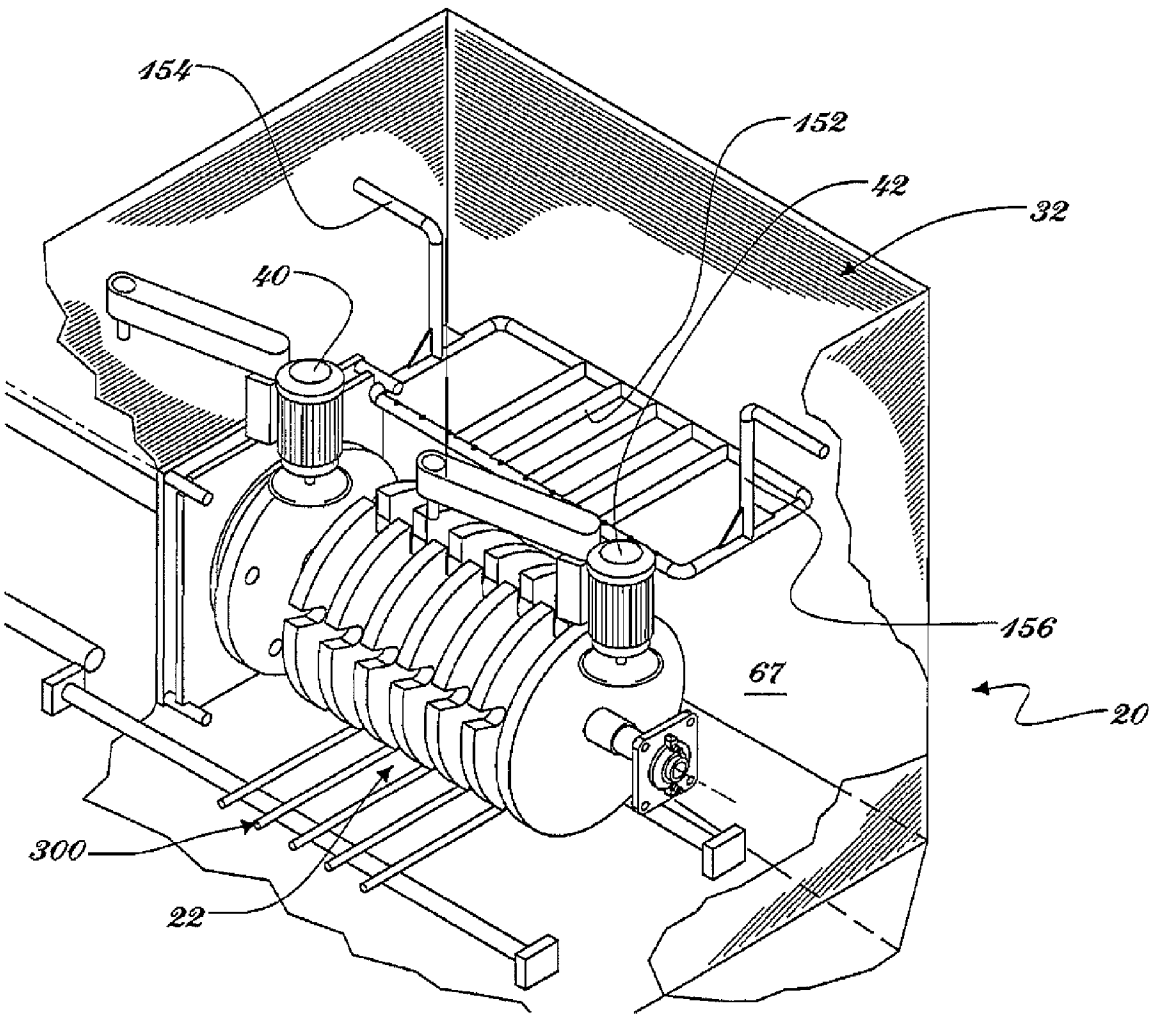
FIGS. 14 and 15 are views similar to FIG. 7, but further showing same in context into the present automatic bag slitter housing in partly broken perspective view, the spike star wheels assembly being shown in its operative condition inside the machine housing in FIG. 14 and in its inoperative maintenance accessible condition outside the machine housing in FIG. 15.

In the alternate embodiment of guide bar assembly 150 of FIGS. 13A, 14 and 15, a flat grate member 152 is supported by two opposite L-shape brackets 154, 156, these brackets 154, 156 being pivotally mounted to opposite pivot mounts in upright walls 32A, 32B of the machine controlled environment bag cutting machine chamber housing 32.

FIGS. 14 and 15 suggest that for foodgrade application at cleaning mode of the star wheel assembly 22, this modular spike star wheel assembly can be slid outwardly of the machine controlled environment housing 32 for inspection, maintenance and cleaning, along a telescopic support sliding rack 300. Rack 300 includes a stationary portion 302, permanently mounted inside housing 32, and a telescopically extendable portion 304, movable from a first limit position overlying the stationary portion 302, to a second limit position fully or almost fully extended outwardly from housing 32, for maintenance access.

Preferably, dust filter means are provided about access areas of the machine housing 32, to enhance atmospheric control of air borne contaminants of the controlled environment bag slitting chamber.

It is therefore understood that the components inside of the machine are designed to be modularly mounted therein: the infeed conveyor C, the spike star wheels assembly 22, the rocker bag separation bar assembly 110 or 150, and the cutter assembly A. All of these modular components are easily removable manually without tools, for cleaning and general maintenance.

The inside of the machine housing 32 also preferably meets the clean-in-place (CIP) standard.

The empty bag compactor 118, 120, may also slide out of the machine housing 32 in the same way as the spike star wheels assembly 22. The integral dust filter may be modular, with the filter cartridge being easily removed.

It will be appreciated that as we do not intend to limit the invention to the above examples only, many variations, such as might readily occur to one skilled in the art, being possible, without departing from the scope thereof as defined by the appended claims.

For optimal operation of the present bag opening and slitting machine, the weight load of powder/granular material inside the full bag G should most preferably range within approximately 5 to 250 pounds.

It is noted that each or some of the star wheels 60, 60A, 60B, . . . of star wheels assembly 22 could be replaced by any other suitably designed disc-like or drum like element or object, hollow or solid, while remaining well within the scope of the present invention. However, a drum like star wheel element would not be optimal in view of the requirement of guaranteeing a contamination free environment inside the bag opening and slitting machine of the present invention.

We claim:

1. A bag opening and emptying machine for cutting bags inside a controlled environment bag slitting chamber, said machine comprising:

a star wheels assembly, including rotatable integral shaft transversely carrying a set of star wheels spaced from one another, wherein a spacer gap is formed between each pair of successive said star wheels along said shaft;

spike means mounted within corresponding said spacer gaps and extendible radially outwardly from and retractable radially inwardly of the periphery of said star wheels assembly;

means for feeding a bag into the controlled environment chamber and onto a conveying surface of said star wheels assembly;

means for extending said spike means radially outwardly of said star wheels assembly so as to impale the bag and firmly secure the latter to said star wheels assembly;

cutting means adjacent the star wheels assembly past which the bag is conveyed in a conveying direction and which serve to make a continuous cut around three sides of the bag whereby the bag is cut into upper and lower halves hingedly joined at the trailing side of the bag;

the star wheels assembly serving to convey one half of the bag impaled on the spike means while the other half unfolds therefrom to release the contents of the bag, said star wheels assembly defining peripheral quadrants;

receiving means for collection of the contents of the bag;

means for retracting said spike means to release the empty bag from the star wheel assembly;

collection means for the empty bag;

a number of radially outwardly opening notches, formed at the periphery of each of said star wheels; and actuator rods each extending through registering said notches from corresponding successive said star wheels, said actuator rods cooperating with said spike means, with said means for extending the spike means, and with said means for retracting said spike means.

2. The bag opening machine according to claim 1, wherein the star wheels assembly is located beneath the path over which the bags travel during ingress from said means for feeding a bag and into said chamber, said star wheels assembly unfolding the two halves of the bag by drawing the half thereof engaged by said spike means over said star wheel assembly, and further including screen means to support the upper half of the bag as the bag is fed over the star wheels assembly and before it is drawn to follow the lower half around said star wheels assembly.

3. The bag opening machine according to claim 1, wherein said actuator rods are rotatably mounted relative to said star wheels, and wherein said spike means are arcuate hooks, each of the latter having a sharp leading edge, said notches and associated actuator rods distributed on successive peripheral quadrants of each of said star wheels.

4. The bag opening machine according to claim 3, wherein said means for extending said spike means and said means for retracting said spike means consist of female cam means and resilient means urging said actuator rods to a position where the arcuate hooks protrude radially outwardly from the conveying surface, and a cam roller associated with each said actuator rod, each said cam roller cooperating with said female earn means in such a way that the actuator rods are rotated against the action of said resilient means to retract said arcuate hooks and subsequently release said arcuate hooks at required positions in a closed loop.

5. The bag opening machine according to claim 3, wherein said star wheels assembly forms a modular component slidably mounted in and out of the controlled environment bag slitting chamber, for facilitating maintenance thereof.

6. The bag opening machine as in claim 1, wherein said cutting means includes two motors selected from the group comprising electric and pneumatic drive motors, said two motors spaced from one another, each of said motors driving a shaft carrying a rotatable blade, each drive motor supported into said chamber, each such motor, shaft and blade located in an operative condition thereof inside said chamber.

7. The bag opening machine according to claim 1, wherein said cutting means comprises two cutters which are arranged for movement inside said chamber in a conveying direction and laterally to said conveying direction to opposite sides respectively of said star wheels assembly, including resilient means which act to urge the cutters inwardly, and one of said cutters being located behind the other in said conveying direction whereby each cutter engages each bag in cutting relationship in the same position on the bag surface to ensure a continuous cut around three sides of the bag.

8. A bag opening machine according to claim 7, wherein each cutter comprises a disc shape cutting blade disposed in a plane parallel with an upper bag conveying surface of said star wheels assembly.

9. The bag opening machine according to claim 1 further including air jet means mounted into said star wheels assembly in closely spaced fashion relative to the downstream quadrant of said star wheels assembly and for engaging an inside surface of the bag as it is unfolded and emptied.

10. The bag opening machine of claim 1, wherein at least some of said spike means includes arcuate hooks, angled in said conveying direction and wherein said bag conveying surface of said star wheels assembly extends substantially horizontally and immediately downstream of said cutting means.

11. The bag opening machine of claim 6, wherein said cutting means drive motors, shafts and blades form a unitary modular component slidably mounted in and out of said controlled environment bag slitting chamber, for facilitating maintenance thereof.

12. The bag opening machine as in claim 1, further including a rocker type guide bar frame, pivotally mounted into a downstream portion of the controlled environment bag slitting chamber, said guide bar frame registering with said conveying surface of said star wheels assembly and enhancing bag separation after said bag is cut by said cutting means, said rocker type guide bar frame forming a module releasably mounted into said chamber wherein maintenance of said guide bar frame is facilitated when released from said chamber.

13. The bag opening machine as in claim 12, wherein said guide bar frame is selected from the group comprising a cross-sectionally triangular shape frame and a cross-sectionally T-shape frame.

14. The bag opening machine as in claim 1, wherein said collection means for the empty bag consists of a bag collection chute, mounted beneath said star wheels assembly, and a powered endless screw system, operating within a compaction tube and pushing the empty bag away from said chamber into another chute toward a reclaim area, said endless screw system extruding the bag into the latter chute where the emptied bags are compacted and pushed into a waste plastic tube in the reclaim area.

15. The bag opening machine as in claim 4, wherein said earn means is a female cam groove, made into an anchor plate at one end of said star wheels assembly, said female cam groove being engaged by said cam roller.

16. The bag opening machine as in claim 1, wherein said receiving means consists of a collection hopper, mounted into said chamber beneath said star wheels assembly, and a fine mesh screen, mounted within said hopper.

17. The bag as in claim 16, further including means inducing high frequency vibration of said mesh screen.

18. The bag opening machine as in claim 13, wherein said guide bar frame includes a hollow elongated frame element having a series of lengthwisely spaced openings, the latter opening forming air outflow nozzles, and further including a pressurized air source feed means operatively connected to said guide bar frame element and enabling pressurized air ejection outwardly therefrom through said air outflow nozzles.

19. A method of slitting open a bag with a bag opening and emptying machine of the type for cutting bags inside a controlled environment bag slitting chamber, wherein the method comprises the following steps:

providing the bag opening and emptying machine having a star wheels assembly, including rotatable integral shaft transversely carrying a set of star wheels spaced from one another, wherein a spacer gap is formed between each pair of successive said star wheels along said shaft, spike means mounted within corresponding said spacer gaps and extendible radially outwardly from and retractable radially inwardly of the periphery of said star wheels assembly, bag feeding means configured to feed a bag into the controlled environment chamber and onto a conveying surface of said star wheels assembly, spike extending means configured to extend said spike means radially outwardly of said star wheels assembly so as to impale the bag and firmly secure the latter to said star wheels assembly, cutting means adjacent the star wheels assembly past which the bag is conveyed in a conveying direction and which serve to make a continuous cut around three sides of the bag whereby the bag is cut into upper and lower halves hingedly joined at the trailing side of the bag, the star wheels assembly serving to convey one half of the bag impaled on the spike means while the other half unfolds therefrom to release the contents of the bag, said star wheels assembly defining peripheral quadrants, receiving means configured to collect the contents of the bag, spike retracting means configured to retract said spike means to release the empty bag from the star wheel assembly, collection means configured to collect the empty bag, a number of radially outwardly opening notches, formed at the periphery of each of said star wheels, and actuator rods each extending through registering said notches from corresponding successive said star wheels, said actuator rods cooperating with said spike means, with said spike extending means, and with said spike retracting means;

actuating said bag feeding means and feeding a bag into said chamber;

actuating said spike extending means and holding in position said loaded bags with the spike members from the spike star wheels assembly;

actuating said cutting means that slit open the loaded bag with the cutting performed on three sides of the bag;

rotating said star wheels assembly shaft in the conveying direction;

when holding steady the bottom of the bag by the spike members, drawing the bag around the star wheels assembly, wherein the bag is turned inside out and the material inside the bag is discharged by gravity;

sifting the material from the bag; and compacting the emptied bag.

* * * * *